US005378088A

United States Patent [19]

Foehrkolb

[11] Patent Number: 5,378,088

[45] Date of Patent: Jan. 3, 1995

[54] RETAINING WALL AND METHOD FOR FORMING, USING SEGMENTED AUTOMOBILE TIRES

[76] Inventor: Nicholas A. Foehrkolb, 2899 Breezy Point Ct., Baltimore, Md. 21221

[21] Appl. No.: 110,066

[22] Filed: Aug. 20, 1993

[51] Int. Cl.[6] ..... E02D 29/02; E02B 3/06

[52] U.S. Cl. ..... 405/284; 405/21; 405/31; 405/262

[58] Field of Search ..... 405/15, 16, 21, 25, 405/30, 31, 33, 262, 284, 285, 258

[56] References Cited

U.S. PATENT DOCUMENTS

| | | | |
|---|---|---|---|
| 3,764,446 | 10/1973 | Martin | 161/36 |
| 3,848,853 | 11/1974 | Way et al. | 256/1 |
| 3,928,701 | 12/1975 | Roehner | 428/222 |
| 3,934,540 | 1/1976 | Bruner et al. | 116/63 P |
| 4,022,434 | 5/1977 | Moore | 256/1 |
| 4,080,793 | 3/1978 | Pulsifer | 61/37 |
| 4,139,319 | 2/1979 | Anderson | 405/16 |
| 4,142,821 | 3/1979 | Doring | 405/258 |
| 4,186,913 | 2/1980 | Bruner et al. | 256/13.1 |
| 4,407,612 | 10/1983 | van Weele | 405/285 |
| 4,592,678 | 6/1986 | McNinch, Jr. et al. | 405/284 |
| 4,785,577 | 11/1988 | Lederbauer | 47/33 |
| 4,825,619 | 5/1989 | Forsberg | 52/562 |
| 5,011,327 | 4/1991 | Thiac | 405/28 |
| 5,046,898 | 9/1991 | McKinney | 405/286 |
| 5,056,961 | 10/1991 | McMeans et al. | 405/284 |
| 5,094,905 | 3/1992 | Murray | 428/218 |
| 5,178,489 | 1/1993 | Suhayda | 405/21 |
| 5,236,756 | 8/1993 | Halliburton | 405/21 X |

*Primary Examiner*—David H. Corbin
*Attorney, Agent, or Firm*—Leonard Bloom

[57] ABSTRACT

A retaining wall is formed from a plurality of segmented automobile tires. The sidewall segments are disposed horizontally to form a row with the ends of adjacent segments overlapping. Openings near the respective ends are aligned to cooperate with one another. A plurality of rows are formed and the openings are vertically aligned to form a height of the wall. Rods are disposed through the aligned openings to interconnect the rows. Tread segments of the tires are connected to the sidewall segments with the tread segments extending outwardly. The tread segments form support sections and may be connected to pilings to provide additional support for the wall.

18 Claims, 5 Drawing Sheets

RETAINING WALL AND METHOD FOR FORMING, USING SEGMENTED AUTOMOBILE TIRES

FIELD OF THE INVENTION

The present invention relates to the segmenting of an automobile tire and the formation of a retaining wall from the segments.

BACKGROUND OF THE INVENTION

There are millions of automobile tires which are disposed of in the United States and which have become a serious environmental problem. The tires rapidly fill up land dumps, do not deteriorate in storage, and introduce problems in incineration.

The applicant is aware of the following U.S. patents which have been directed to finding uses for the discarded tires:

| Inventor(s) | U.S. Pat. No. |
|---|---|
| Martin | 3,764,446 |
| Way et al | 3,848,853 |
| Roehner | 3,928,701 |
| Bruner et al | 3,934,540 |
| Moore | 4,002,434 |
| Pulsifer | 4,080,793 |
| Anderson | 4,139,319 |
| Doring | 4,142,821 |
| Bruner et al | 4,186,913 |
| Lederbauer | 4,785,577 |
| Thiac | 5,011,327 |
| McMean et al | 5,056,961 |
| Murray | 5,094,905 |
| Suhayda | 5,178,489. |

While these patents are useful, they have not been generally implemented and the environmental problem continues to worsen. Further these patents do not disclose nor suggest, as does the present invention, the segmenting the tire into members which no longer retain the tubular or semi-tubular structure of the tire and using these members to form a retaining wall.

The applicant is also aware of the following U.S. Patents which disclose retaining walls formed from solid blocks.

| Inventor(s) | U.S. Pat. No. |
|---|---|
| van Weele | 4,407,612 |
| McNinch, Jr. et al | 4,592,678 |
| Forsberg | 4,825,619 |
| McKinney | 5,046,898. |

The blocks are inherently different from the resilient segments of automobile tire but are cited to show the construction of retaining walls.

Thus, a need exists to find a utilitarian and cost effective use for automobile tires.

SUMMARY OF THE INVENTION

It is a primary object of the present invention to use segmented automobile tires to form a retaining wall which is cost effective to form and which solves an environmental problem of disposing of automobile tires.

It is another object of the present invention to provide a method of using segmented automobile tires to prepare a retaining wall.

In accordance with the teachings of the present invention there is disclosed a retaining wall formed from a plurality of segmented automobile tires. Each tire has a tread portion around a circumference of the tire. Said tread portion is removed and each residual sidewall portion is cut into segments of approximately equal sizes. The sidewall segments are disposed as horizontal members of the retaining wall. Each horizontal member has respective opposite ends and at least one opening is formed near each end of each member. A plurality of horizontal members are disposed adjacent to one another along a length to form a row. The respective ends of adjacent members overlap such that the openings near the respective ends of adjacent members are aligned to cooperate with one another. A plurality of rows are formed and aligned vertically with respect to one another. When so aligned, the openings in the members of each row are vertically aligned and cooperate with the openings in the members in the rows above and rows below to form a height of the wall. A plurality of rods are provided. One rod is disposed in each vertical alignment of openings whereby the rows of horizontal members are interconnected to form the wall. The wall may be a desired height and a desired length and the wall may be formed to conform to the topography of the ground on which the wall is constructed. The wall has a back surface and a plurality of spaced-apart modular support sections are connected to, and extend outwardly from, the back surface of the wall. As desired, the support section is connected to a respective piling in the ground to provide additional support to the wall.

In further accordance with the teachings of the present invention, there is disclosed herein a method of forming a retaining wall from automobile tires. Each automobile tire has sidewalls and a tread portion about a circumference of the tire. The tread portion is cut from around the circumference of each tire and the tread portion is separated from the sidewalls. The sidewalls of the tire are cut into a plurality of approximately equal size members. Each member has a first end and a second end. A respective opening is formed near the first end and near the second end of each member. A plurality of members are disposed horizontally adjacent to one another so that the first end of the one member overlaps with the second end of the adjacent member. The respective openings near the overlapping ends are aligned to cooperate with one another, thereby forming a row of horizontal members along a length. A plurality of rows are aligned vertically with respect to one another, wherein the opening in the members of each row are vertically aligned and cooperate with the openings in the row above and the row below to form a height of the wall- A plurality of rods are inserted into the aligned openings in the members. One rod is disposed in each vertical alignment of openings whereby the rows of horizontal members are interconnected to form the wall.

In another aspect of the present invention, each separated tread portion is cut into a plurality of segments. Each segment has a first end and an opposite second end. A first opening is formed near the first end and a second opening is formed near the second end of each segment. The first end of each respective segment is tied to the wall by aligning the first opening of the respective segment with the vertical alignment of the openings in the members. The rod in the aligned openings is received in the opening in the first end of the respective segment. The second end of the respective segment extends outwardly from the back surface of the wall.

These and other objects of the present invention will become apparent from a reading of the following specification, taken in conjunction with the enclosed drawings.

DESCRIPTION OF PREFERRED EMBODIMENTS

Figure 1:
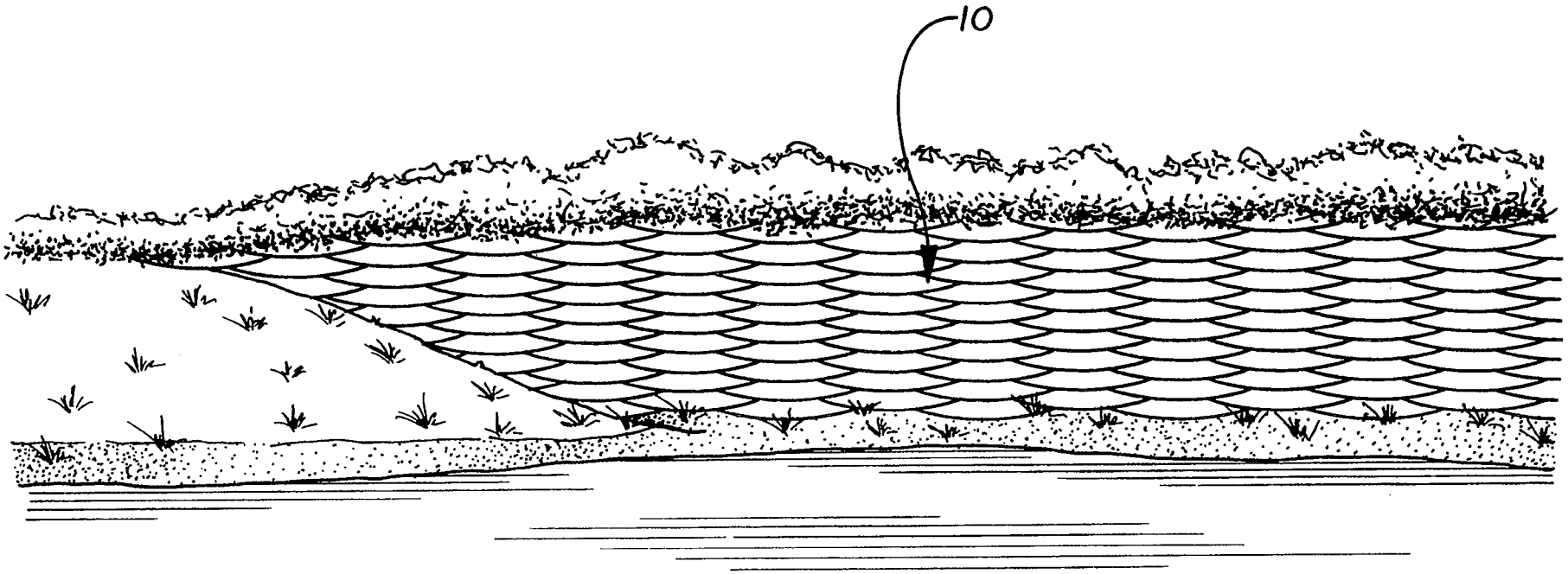
FIG. 1 is a perspective view of the present invention showing the retaining wall conforming to the topography of the ground on which the wall is constructed.
Figure 3:
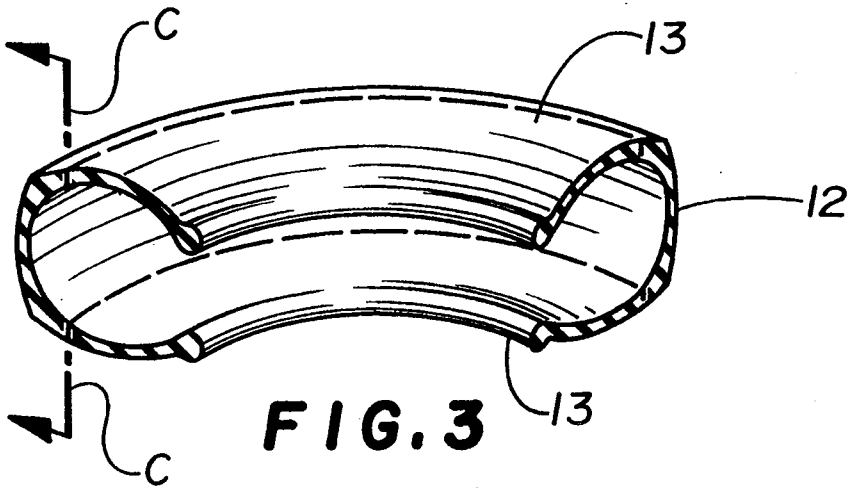
FIG. 3 is a perspective view showing the cutting of the tread from the segment of the tire.
Figure 5:
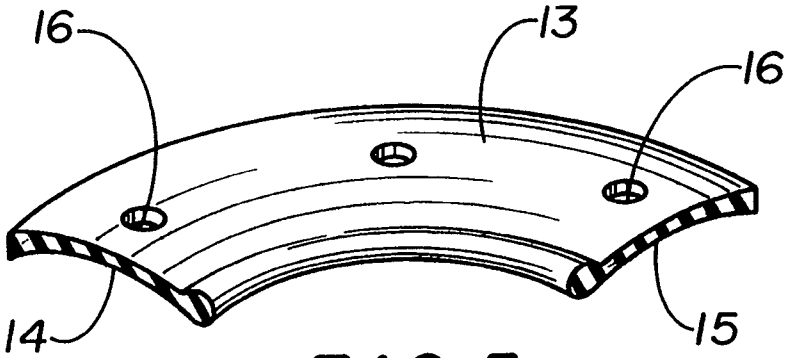
FIG. 5 is a perspective view of the sidewall segment of the tire.
Figure 2:
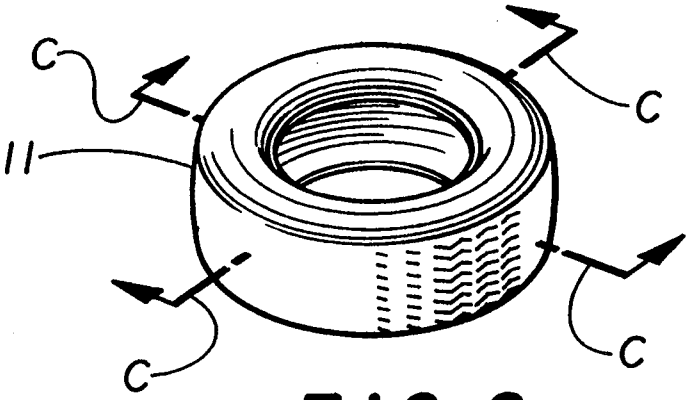
FIG. 2 is a perspective view showing an automobile tire which is cut into segments.
Figure 4:
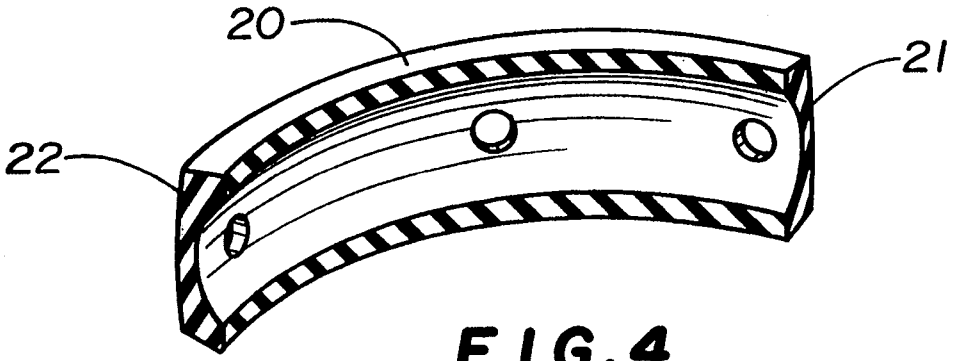
FIG. 4 is a perspective view of the tread section of the tire after removal from the segment of the tire.

Referring now to FIG. 1, the retaining wall 10 of the present invention may be constructed to conform to the topography of the ground. The retaining wall 10 has a wide variety of applications including earthen embankments, breakwaters, highway deflector railings and more. The retaining wall 10 is aesthetically pleasing and the components are connected so as to conform to any topography.

As shown in FIGS. 2–5, an automobile tire 11 is segmented to remove the tread portion 12 from around the circumference of the tire 11 and to leave a pair of circular residual sidewalls which are cut into approximately equal size sidewall segments 13. Preferably, each sidewall is cut C into four sidewall segments such that eight sidewall segments are obtained from each tire 11 and the tread portion 12 is removed in a single operation. Alternately, the tire 11 may be segmented initially and then the tread portion 12 removed from each sidewall segment to produce the approximately equal size sidewall segments 13. The former segmenting procedure is preferred since it is cost effective in reducing the number of operations required to segment the tire.

Each sidewall segment 13 has a first end 14 and an opposite second end 15.

Figure 6:
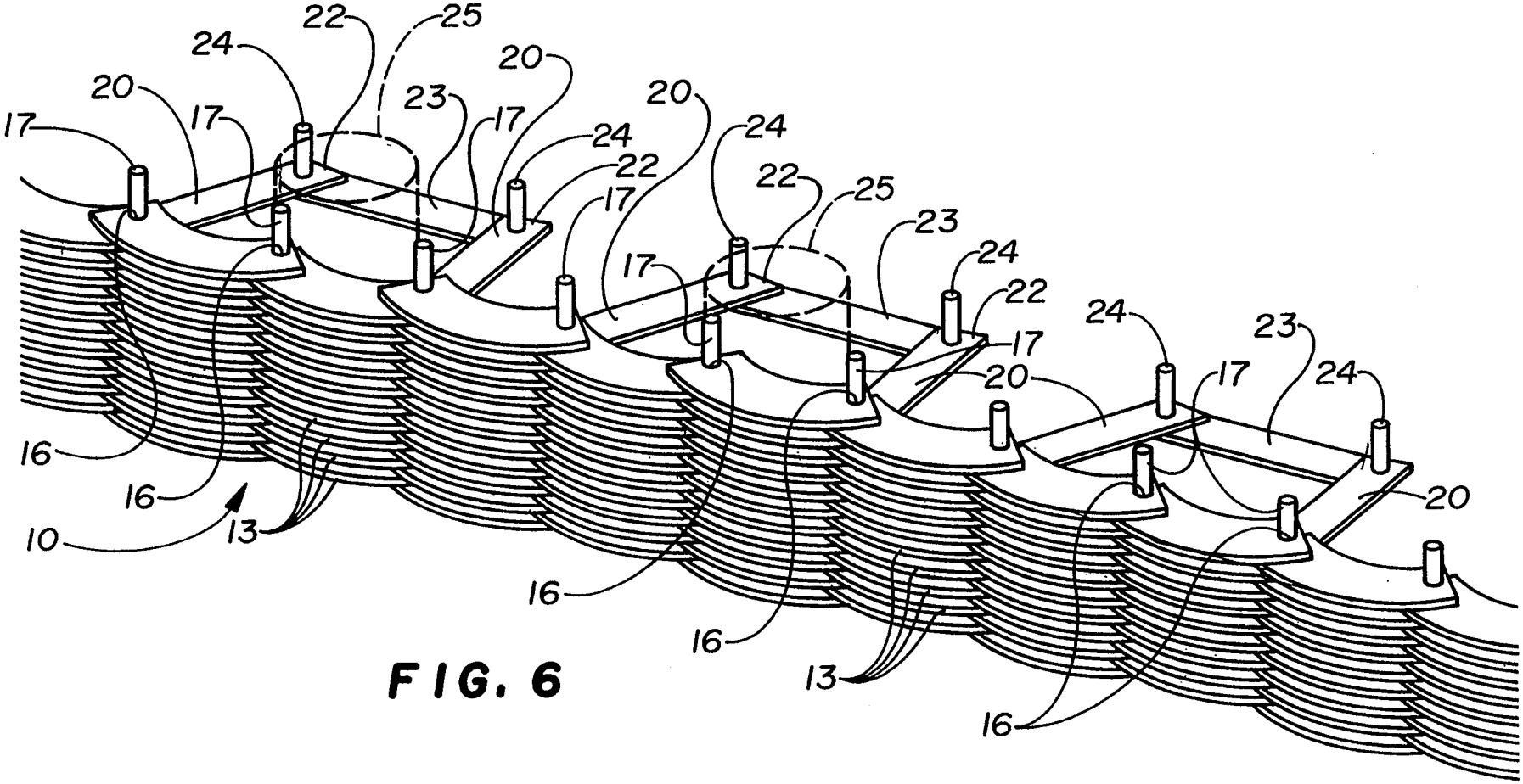
FIG. 6 is a perspective view of the retaining wall of the present invention.

An opening 16 is formed near each end 14, 15 of each sidewall segment 13 and, if desired, additional spaced-apart openings may be formed in each sidewall segment 13. As seen in FIG. 6, a plurality of sidewall segments 13 are disposed as horizontal members 13 alongside one another to form a row. The respective ends 14, 15 of adjacent horizontal members 13 overlap one another. The openings 16 near the respective ends 14, 15 of the adjacent members 13 are aligned to cooperate with one another. The ends 14, 15 of the adjacent horizontal members 13 may overlap to provide a row in a single plane or the adjacent horizontal members may be arranged in a step-like manner. The latter arrangement is preferred in forming the retaining wall on a slope or hill. Combinations of the arrangements can be incorporated into a single wall. The combination also produces an aesthetically pleasing effect. A plurality of rows are formed and aligned vertically with respect to one another. In this manner, the openings 16 in the members 13 in each row are vertically aligned and cooperate with the openings 16 in the members 13 in the rows above and the rows below. This vertically array forms a height of the wall 10. A rod 17 is disposed in each vertical alignment of openings 16. The rods 17 interconnect the rows of members 13. If desired, each rod 17 may be driven into the ground beneath the wall to anchor the wall to the ground (FIG. 6).

If desired, the additional spaced-apart openings formed in the horizontal members 13 are also aligned vertically and may also receive rods 17 therein to provide added structural reinforcement to the wall.

Since the adjacent men, hers 13 may be increased or decreased to form a row of any desired length and the number of rows can be increased or decreased to any desired height, it is possible to construct a wall which conforms to the topography of the ground on which the wall is disposed. Thus, the base of the wall is easily formed to account for small rises and depressions in the natural topography. This feature eliminates the need for grading a surface on which the restraining wall is to be constructed.

In order to provide added support to the wall 10, a plurality of spaced-apart tread segments 20 are connected to the wall 10 and extend outwardly from the back surface of the wall 10. The tread segments 20 are formed from the tread portion 12 by cutting the tread portion 12 from each tire 11 into, preferably, approximately equal size tread segments 20. Each tread segment 20 has a first and 21 and an opposite second end 22. Openings are formed near the end 21, 22 of each tread segment 20. The first ends 21 of the tread segments 20 are disposed between the horizontal members 13 in the wall 20 such that the openings near the first ends 21 of the tread segments 20 are aligned with the openings 16 in the horizontal members 13. The vertical rods 17 are received in the openings near the first ends 21 of the tread segments such that the tread segments 20 are tied to the wall 10 and extend outwardly from the back surface of the wall 10.

Figure 7:
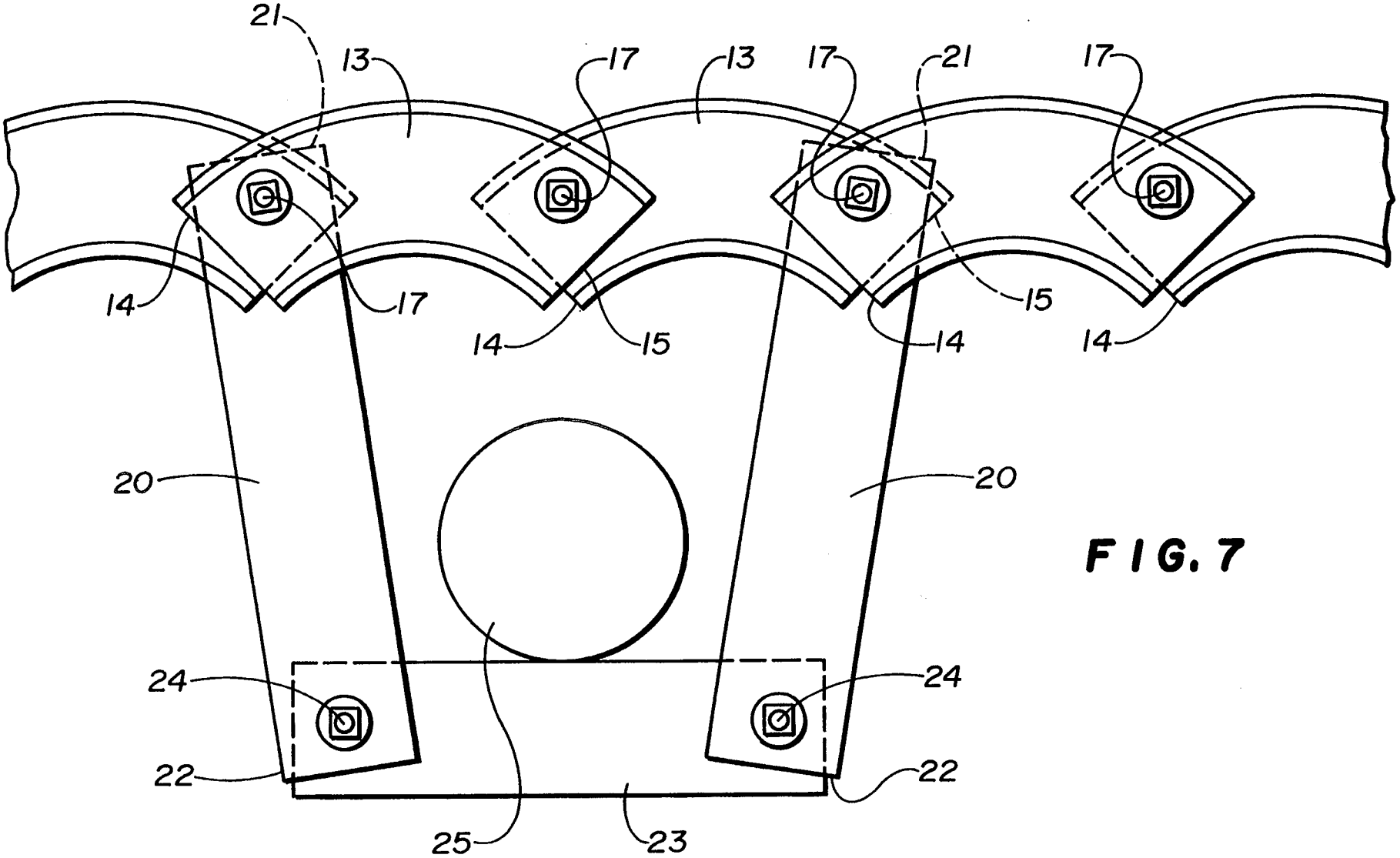
FIG. 7 is a top plan view of the retaining wall of the present invention showing the U-shape support section.

In a preferred embodiment (FIG. 7), the respective second ends 22 of two adjacent spaced-apart tread segments 20 extending outwardly from the wall 10 are joined by a third tread segment 23. The openings near the second ends 22 of the two respective adjacent tread segments 20 are connected to the openings near the end of the third tread segment 23 such that a U-shaped section is formed. The third tread segment 23 is the base of the U-shape and the two adjacent tread segments 20 are the legs of the U-shape. The connection between the openings near the second ends 20 of tread segments 20 and the openings in the third tread segment 23 may be by a respective rod 24 received in the openings. A plurality of the U-shaped sections may be formed along the length of the wall 10 and a further plurality of the U-shaped sections may be formed in a vertical array in the height of the wall 10. In this manner, as desired, the support sections may be disposed on the back of the wall 10. In order to provide additional support for the wall 10, a piling 25 may be disposed between the back of the wall 10, the legs 20 of the U-shape section and the base 23 of the U-shaped section. The piling 25 may be driven into the ground to anchor the wall 10. A piling 25 may be disposed in each of the plurality of U-shaped sections or in any of the U-shaped sections as desired.

Figure 8:
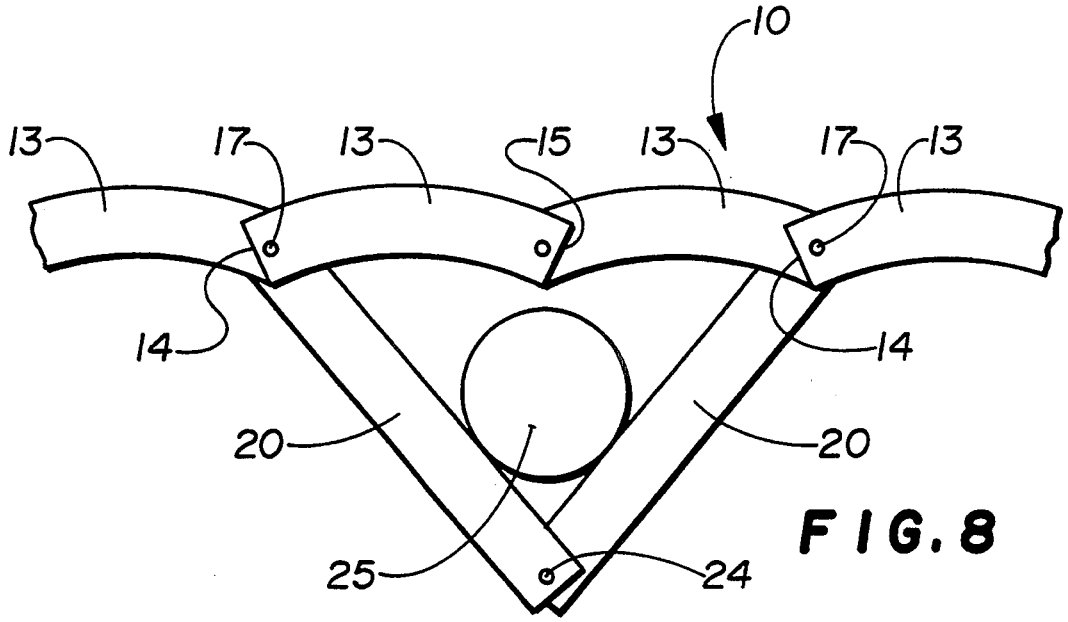
FIG. 8 is a top plan view of the retaining wall of the present invention showing the V-shape support section.

In another embodiment (FIG. 8), the respective second ends 22 of the two adjacent spaced-apart tread segments 20 extending outwardly from the back of the wall 10 are joined together. The openings near the respective ends 22 are connected such that the two adjacent tread segments 20 for a V-shaped section. The connection between said openings may be a rod 24. A plurality of the V-shaped sections may be formed along the length of the wall 10 and a further plurality of V-shaped sections may be formed in a vertical array in the height of the wall 10. Additional support for the wall 10 may be provided by disposing a piling 25 between the back of the wall 10 and the tread segments 20 forming the V-shaped section.

Figure 9:
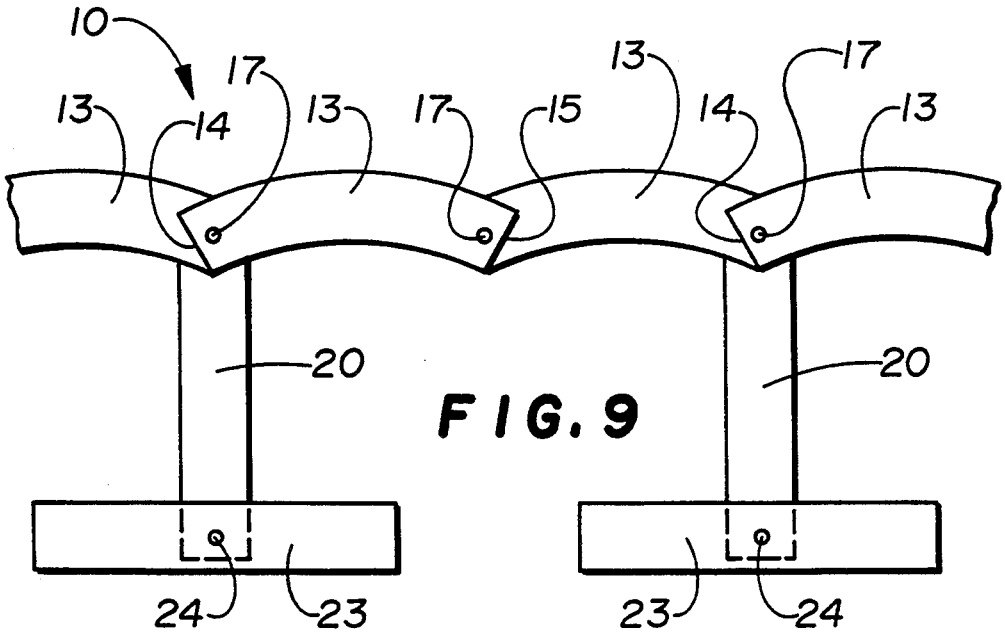
FIG. 9 is a top plan view of the retaining wall of the present invention showing the T-shape support section.

Still another embodiment (FIG. 9) the second end 22 of the tread segment 20 extending outwardly from the back of the wall is connected to approximately the center portion of a third tread segment 23 such that a T-shaped section is formed. An opening in the center portion of the third tread segment 23 is connected to the opening near the second end 22 of the tread 20 extending from the wall 10. A rod 24 may be disposed in the openings to join the segments 20, 23. A plurality of T-shaped sections may be disposed along the length of the wall 10 and a further plurality of T-shaped sections may be formed in a vertical array in the height of the wall 10.

Figure 10:
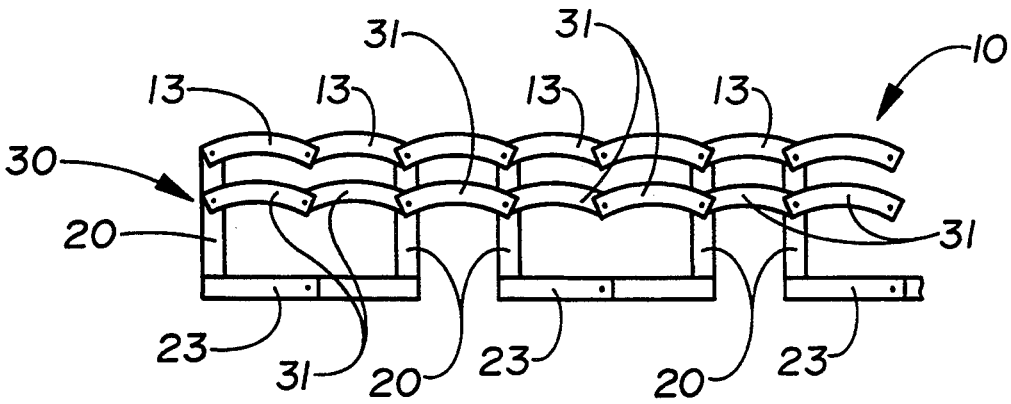
FIG. 10 is a perspective view showing the present invention having a double retaining wall.

In another embodiment (FIG. 10) where additional strength is needed for the retaining wall 10 or where the height of the wall 10 requires additional depth to the wall 10, the outwardly extending tread segments 10 are connected to a second retaining wall 30. The second wall 30 is constructed in a manner identical to the first retaining wall 10 having rows of horizontal members 31 interconnected by openings near the respective ends of adjoining horizontal members 31. The openings in the second end 22 of the outwardly extending tread segment 20 are connected to the openings in the horizontal members 31 in the second wall 31 to tie the first wall 10 to the second wall 30. A plurality of the laterally and vertically disposed tread segments 20 effectively interconnect the first wall 10 and the second wall 30 along the length and height of the respective walls. If desired, the two walls 10, 30 may be of differing lengths and differing heights as required in the particular use and the topography of the installation site.

The retaining wall 10 of the present invention is formed by cutting a plurality of automobile tires 11 into sidewall segments 13 and tread segments 20. Openings are formed near the ends 14, 15 of the segments 13, 20 and if desired in other portions of the segments. The sidewall segments 13 are disposed horizontally with the ends 14, 15 overlapping so that the openings 16 near the ends are aligned. The horizontal members 13 form a row and a plurality of rows are formed vertically. The openings 16 near the ends 14, 15 of the horizontal segments 13 are aligned and rods 17 are disposed in the aligned openings 16 to connect the rows. The rods 17 are connected to the ground to anchor the wall 10. The openings near the first ends 21 of the tread segments 20 are aligned with the openings 16 in the horizontal members 13 and the tread segments are disposed outwardly from the back surface of the wall 10. Modular support sections are formed on the back section of the wall 10. The support sections may be U-shaped, V-shaped, T-shaped or combinations thereof and are formed from tread segments 20. The support sections may be formed along the length of the wall 10 and in a vertical array in the height of the wall 10. If desired, pilings 25 may be disposed between the back of the wall 10 and the respective support sections, the pilings 25 being driven into the ground to provide additional support. The tread segments 20 extending outwardly from the back of the wall 10 may be connected to a second wall 30. The second wall 30 is formed from segmented automobile tires 11 in a manner identical to the first wall 10.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A retaining wall formed from a plurality of segmented automobile tires, each tire having a tread portion around a circumference of the tire and a pair of sidewalls, said tread portion being removed and each residual sidewall portion being cut into segments of approximately equal sizes, the retaining wall comprising the sidewall segments being disposed as horizontal members, each horizontal member having respective opposite ends and an opening being formed near each end of each member, a plurality of horizontal members being disposed adjacent to one another along a length to form a row, the respective ends of adjacent members overlapping, the openings near the respective ends of adjacent members being aligned to cooperate with one another, a plurality of rows being formed and aligned vertically with respect to one another wherein the openings in the members of each row are vertically aligned and cooperate with the openings in the members in the rows above and rows below to form a height of the wall, a plurality of rods, one rod being disposed in each vertical alignment of openings whereby the rows of horizontal members are interconnected to form the wall and wherein the wall may be a desired height and a desired length and the wall may be formed to conform to the topography of the ground on which the wall is constructed.

2. The retaining wall of claim 1, wherein each rod anchors the wall.

3. The retaining wall of claim 1, further comprising the wall having a back surface, a plurality of spaced-apart modular support sections being connected to the back surface of the wall and extending outwardly therefrom.

4. The retaining wall of claim 3, wherein each modular support section has three segments, each segment having opposite ends with openings formed near the ends of each segment, the segments being disposed in a substantially U-shape wherein two of the segments form the legs of the U-shape and the third segment forms the base of the U-shape, the openings in the third segment being connected to openings near one end of each of the segments forming the legs of the U-shape, the openings near the respective opposite ends of each of the segments forming the legs of the U-shape being aligned with and connected to the openings in the horizontal members of the wall, whereby the vertical rods inserted in the openings in the horizontal members are received in the openings near the opposite ends of the segments forming the legs of the U-shape.

5. The retaining wall of claim 4, further comprising a piling disposed between the back of the wall, the legs and the base of each respective support sections.

6. The retaining wall of claim 5, further comprising a plurality of support sections vertically aligned in the height of the wall, the respective piling being disposed between the back of the wall, the legs and the bases of each of the plurality of support sections.

7. The retaining wall of claim 5, further comprising a plurality of spaced-apart support sections and pilings along the length of the wall.

8. The retaining wall of claim 3, wherein each tread portion is cut into segments of approximately equal size, the segments of the support sections being formed from the tread portion segments.

9. The retaining wall of claim 3 being a first wall and further comprising the outwardly extending support section being connected to a second retaining wall, the second retaining wall being formed identically as the first wall.

10. A method of forming a retaining wall from automobile tires, each automobile tire having sidewalls and a tread portion about a circumference of the tire, the method comprising the steps of:

cutting the tread portion from around the circumference of each tire and separating the tread portion from the sidewalls, cutting the sidewall of the tire into a plurality of approximately equal size members, each member having a first end and a second end, forming a respective opening near the first end and near the second end of each member, disposing a plurality of members horizontally adjacent to one another so that the first end of the one member overlaps with the second end of the adjacent member and the respective openings near the overlapping ends are aligned to cooperate with one another, thereby forming a row of horizontal members along a length, forming a plurality of rows aligned vertically with respect to one another, wherein the openings in the members of each row are vertically aligned and cooperate with the openings in the row above and the row below to form a height of the wall, inserting a plurality of rods into the aligned openings in the members, one rod being disposed in each vertical alignment of openings whereby the rows of horizontal members are interconnected to form the wall.

11. The method of claim 10, further comprising driving each rod into the ground beneath the wall to anchor the wall.

12. The method of claim 10, further comprising the wall having a back surface, cutting the separated tread into a plurality of segments, each segment having a first end and an opposite second end, forming a first opening near the first end and a second opening near the second end of each segment, tying the first end of the respective segment of separated tread to the wall by aligning the first opening of the respective segment with the vertical alignment of openings in the members and the rod in the aligned openings is received in said first opening, whereby the second end of the respective segment extends outwardly from the back surface of the wall, securing the second end of the respective segment of the segmented tread outwardly from the wall to provide support for the wall.

13. The method of claim 12, further comprising providing a rod for each outward extending segment and passing said rod through said second opening and into the ground.

14. The method of claim 12, further comprising forming a plurality of laterally spaced-apart modular support sections, as desired, driving a plurality of support pilings in the ground along the length of the wall and securing the respective support sections to the respective pilings.

15. The method of claim 12, further comprising forming a plurality of support segments vertically aligned in the height of the wall, as desired driving a support piling in the ground adjacent to the plurality of support segments and securing the support segments to the piling.

16. The method of clam 12, further comprising a plurality of outwardly extending segments of separated tread being provided adjacent to one another, forming pairs of adjacent segments and joining the second end thereof to a respective third segment of separated tread, the respective third segments being connected between the adjacent segments to form a plurality of substantially U-shape sections with respect to the back surface of the wall, the respective third segments forming a base to each of the U-shape sections, as desired, disposing a supporting piling within each of the U-shape sections between the adjacent segments, the base and the back surface of the wall, driving the respective supporting pilings into the ground to anchor the wall and provide support to the wall.

17. The method of claim 12, further comprising connecting the second opening of each outwardly extending segment to an opening in a center portion of another respective segment such that each other segment forms the cross piece of a T-shape section.

18. The method of claim 12, further comprising a plurality of outwardly extending segments of separated tread being provided, adjacent to one another, forming pairs of adjacent segments and joining the second ends thereof to form a plurality of V-shape sections with respect to the back surface of the wall, aligning the second openings in said second ends and connecting the second ends, as desired, disposing a supporting piling within the respective V-shape section between the adjacent segments and the back surface of the wall, and driving the supporting pilings into the ground to anchor the wall and provide support for the wall.

* * * * *